US005551911A

United States Patent [19]

Rumbach

[11] Patent Number: 5,551,911

[45] Date of Patent: Sep. 3, 1996

[54] SYSTEM FOR HANDLING COINS

[75] Inventor: Karl F. Rumbach, Alfter-Witterschlick, Germany

[73] Assignee: Standardwerk Eugen Reis GmbH, Bruchsal, Germany

[21] Appl. No.: 418,519

[22] Filed: Apr. 7, 1995

[30] Foreign Application Priority Data

Apr. 8, 1994 [DE] Germany ..... 44 12 092.3

[51] Int. Cl.[6] ..... G07D 3/14

[52] U.S. Cl. ..... 453/3

[58] Field of Search ..... 453/3, 4, 5, 6, 453/7, 9, 10, 11, 12

[56] References Cited

U.S. PATENT DOCUMENTS 3,771,538 11/1973 Reis .
3,788,440 1/1974 Propice et al. ..... 453/3 X
4,558,711 12/1985 Ikuta Yoshiaki et al. ..... 453/3
5,230,653 7/1993 Shinozaki et al. ..... 453/4

FOREIGN PATENT DOCUMENTS 0269690 12/1991 European Pat. Off. .
2136657 7/1973 Germany .
380819 9/1989 Germany .
WO03/18488 9/1993 WIPO .

*Primary Examiner*—F. J. Bartuska
*Attorney, Agent, or Firm*—Baker & Daniels

[57] ABSTRACT

A system for handling, and in particular sorting and counting, coins or similar disk-shaped objects. The coins are transferred from a horizontal loading tray to a circular sorting track and sorting disk equipped with separating devices. Between the loading tray and the sorting track with the sorting disk is provided a control track that transports the coins, singularizes the coins and passes them at controlled spacing via recognition, stopping and deflecting systems from the loading tray to the sorting track and sorting disk.

13 Claims, 1 Drawing Sheet

SYSTEM FOR HANDLING COINS

BACKGROUND OF THE INVENTION

1. Field of the Invention

The present invention relates to a system for handling, notably counting and/or sorting, coins or similar disk-shaped objects, where the coins are fed to a horizontal loading tray and then transferred, individually and successively, to a circular sorting track equipped with separating means and a sorting disk.

2. Description of the Prior Art

Systems of this type have been long known (refer to DE-OS 21 36 657) and serve to separate coins or comparable disk-shaped objects such as tokens from a jumble of different coins in accordance with their specific diameter while at the same time counting them. The capacity and reliability of these prior coin sorters and counters depend basically on the speed with which the coins are delivered from the horizontal loading tray and passed individually and successively to the sorting track with the sorting disk. The spacing between individual coins is beyond control and individual successive coins may even touch.

According to the aforementioned prior coin sorting and counting machines, there are two trays provided which rotate in opposite directions, of which one (the loading tray) rotates beneath the supply container and forces the coins by means of centrifugal force to the edge, from where they proceed via a transfer channel to the second rotary tray with diameter-specific sorting apertures. According to a more recent development of a coin sorting system, slightly overlapping rotary trays are provided (refer to WO 93/18488), and the coins are picked up successively from the loading tray by elastic, radial "fingers" arranged on the sorting disk. This latter system, also, transfers the coins from the loading tray to the sorting track at uncontrolled spacing.

Hence, with the coin sorting and counting systems known today, only coins with different diameters can be sorted; foreign and false coins with the same diameter can thus not be separated. Likewise it is not possible either to reliably separate coins having the same or approximately the same diameters from a mix of coins to be sorted. All of the prior systems count the coins only at their separating apertures and in such a way that the coins dropping in the aperture are being counted. Owing to the shortcomings in separation, false coins are counted also, with "false" meaning here any coin which does not specifically belong to a sorting aperture, or sorting switch.

A particular problem with the prior system is that the sorting and exact counting of prescribed quantities of coins in conjunction with their bagging or packaging is more than problematic. The problem is that upon recognition, or counting, of the last $n^{th}$ coin of the prescribed amount of coins to be bagged, at the sorting aperture, the sorting disk must be stopped and that here, with specific sequential groupings of coins, the $(n+1)^{th}$ coin cannot be prevented from tagging along.

Also in view of the transit, or transfer, of the coins from the loading tray to the sorting disk, the prior systems have proven to be problem-prone whenever the transfer is effected by frictional entrainment on the part of the sorting disk. For example, with a thick and thin coin following each other immediately, an insufficient pressure upon the thin coin is a likely result, which can lead to malfunctions. This impairs the accuracy and capacity of the system as a whole.

SUMMARY OF THE INVENTION

The problem underlying the present invention is to eliminate the aforementioned problems and to provide a coin sorting system which recognizes, counts and separates coins of any kind reliably and which promotes optimum operation in view of the aforementioned bagging problem and the slippage problem with coins of different thicknesses.

The aforementioned problem is solved in that a control track is provided between the loading tray and the sorting track, which reaches into the loading tray and empties in the sorting track; and in that in the entrance area of the control track there are systems arranged for recognition, deflection and stopping of the successively fed coins.

The core of the present invention is constituted by transferring the coins successively to a control track along which a central coin recognition system is arranged.

This coin recognition system may be equipped with sensors of different specifications, so that the coins to be sorted (and counted) can be examined also in view of their thickness, alloy, their striking (i.e., their design) and their knurling. Based on this identification criteria it is possible to count the coins centrally, prior to their transfer to the sorting disk, and to generate for instance control, or deflection, signals which accompany a coin on its path insofar as it can be channeled out of the stream of coins already before being channeled into the sorting track (as with false coins, for example) or can be reliably separated along the sorting track of same-diameter coins (different valence). Owing to the clear recognition of all coins prior to passing them to the sorting track, moreover, a reliable and unequivocal stopping mechanism can be realized, thus being able to bag, or pack, a prescribed quantity of identical coins.

The particular advantage of the control track following the loading tray can notably be seen also in the fact that, based on the singularizing devices known in conjunction with coin sorting systems, the removal of the coins from the loading tray takes place in an orderly and defined fashion by way of a difference between feeding and withdrawal speed at the transfer station of the loading tray. Thus, no uncontrolled pressure on the coin is created in the coin transfer, and likewise it is not possible for coins to butt directly against one another, that is, feed to the sorting track under contact.

In a very specific embodiment with the dual unit for coin singularization and coin sorting consisting of the loading tray and the sorting disk there is coordinated—with the control track connecting the functional units functionally—a return track by way of which coins can be recycled to the loading tray at the end of a sorting operation, and thus at the end of the sorting track.

The return track is employed in conjunction with the coin sorting and counting system whenever each coin is unequivocally identified by way of the control track at the transfer point between the loading tray and the sorting disk and when the sorting operation along the sorting track of the sorting disk is carried out not solely by way of the coin diameter, i.e., solely by mechanical criteria. This application of the system does not hinge on the coin sorting operation. Rather, the coin sorting and counting system is used as output device for output of very specific mixes of coins that can be preset by way of the central coin recognition system.

A particular advantage of a coin sorting and counting system equipped with a return track is that, for instance, bagging operations can proceed without any stoppage because the $(n+1)^{th}$ coin, e.g., is simply returned again to the loading tray.

Furthermore, as already mentioned, predefined coin mixes can be composed, individual coin values can be sorted out of any coin mix, and separate coin values can be composed at a very specific ratio to one another.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawing, wherein.

DETAILED DESCRIPTION OF THE INVENTION

Figure 1:
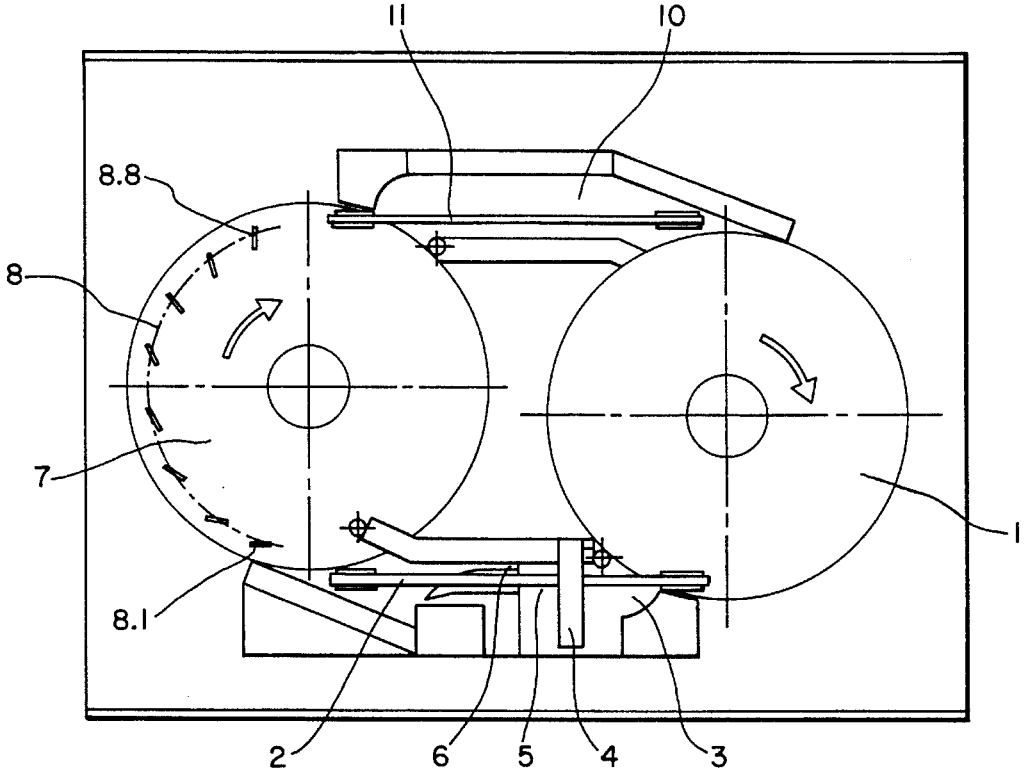
FIG. 1 shows a system for handling, counting and sorting of coins or the like which consists of a loading tray and a sorting track with a sorting disk.
Figure 2:
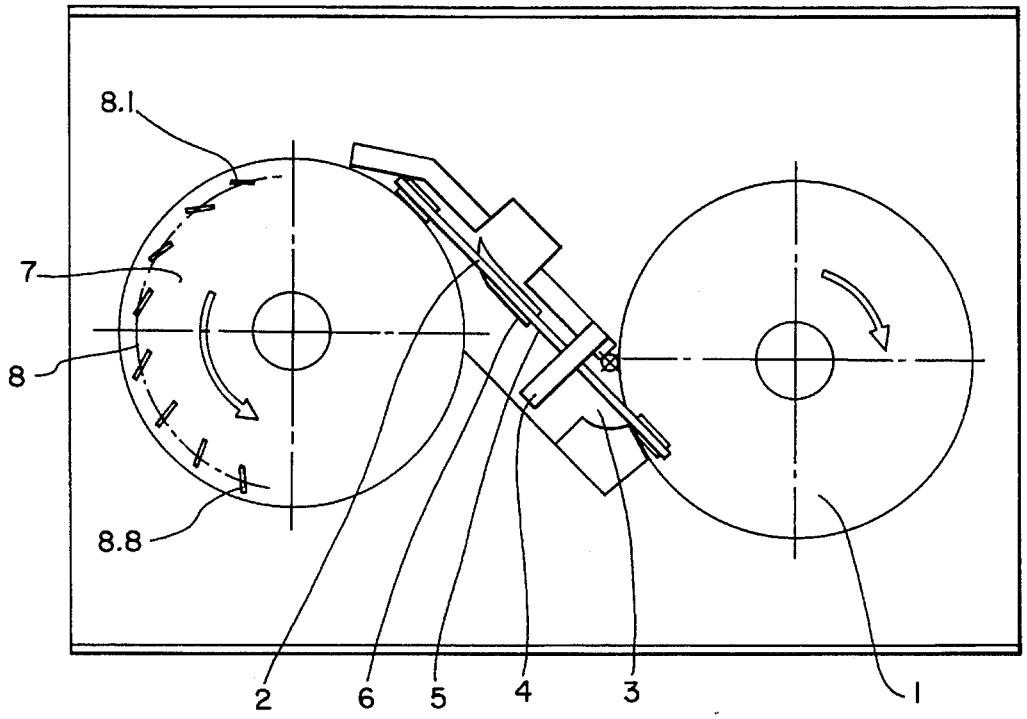
FIG. 2 shows a system for handling, counting and sorting of coins or the like which includes a loading tray, sorting track and disk, and a control track which intersects a connecting line extending between the drive axles of the loading tray and sorting disk.

The drawing shows a loading tray 1 to which coins or similar disk-shaped objects are fed by way of a supply container (not shown). The coins are separately and successively placed on a control track 3 by means of a conveyer belt 2. Coordinated with this control track 3, behind the delivery area of loading tray 1, is a known coin recognition system 4 with a sensor field which scans each coin separately and generates for each coin a specific signal. Apart from coin recognition system 4, a known stopping device 5 as well as a known separating, or deflecting, system 6 for separation of foreign and false coins are arranged along control track 3. Examples of these devices are described in WO 87/07742 (EP 0269690B1), and DE-OS 3808159, which are expressly incorporated herein by reference.

The coins passing from loading tray 1 via conveyer belt 2 along control track 3 are then fed to a circular sorting track 8, to which the coins are transferred by conveyer belt 2. The coins are then frictionally entrained by means of sorting disk 7, that is, positively moved along a guide edge F of sorting track 8. Provided along sorting track 8 are separating stations, or deflecting systems (sorting stations), 8.1—eight in the drawing—each of which can be activated in a coin-specific way. The separating stations, or deflecting systems, 8.1 are fashioned as diameter-dependent separating apertures. In this case, the coins with the smallest diameter are then separated by the separating system 8.1 nearest control track 3, whereas the farthest separating system 8.8 separates the coins with the largest diameter. But also possible are separating stations, or deflecting systems, 8.1 where coins are deflected sideways by the sorting track 8 on the basis of nonmechanical differentiation criteria. This makes it possible, for example, to separate at the deflecting system 8.1 the largest coins and at the far deflection system 8.8 the smallest coins.

According to the embodiment illustrated in the drawing, control track 3 extends essentially parallel to the connecting line of the drive axles of loading tray 1 and sorting disk 7. Basically, it is possible also to arrange, or coordinate, the control track in such a manner that it intersects the connecting line.

According to a preferred embodiment, the coin recognition and sorting system illustrated and described with the aid of the drawing can be provided with a return track 10 arranged at the end of sorting track 8, about parallel to control track 3. Here, any coins not separated are returned to the loading tray 1 by means of a return conveyer belt 11.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A system for sorting coins and similar disk-shaped objects comprising:

a generally horizontal and circular loading tray;

a circular sorting track and sorting disk, said sorting track being equipped with sorting devices for sorting coins on one of a diameter-dependent and diameter-independent basis and said sorting disk comprising an elastic friction material;

a control track extending between said loading tray and said sorting track and disk, said control track adapted to singularize, separate and transport coins from said loading tray to said sorting track and disk, said control track being provided with a coin sensing device and a coin conveying mechanism extending from said loading tray to said sorting track and disk, said control track being disposed in a position which is substantially tangential to both said loading tray and said sorting track and disk.

2. The system for handling coins according to claim 1, wherein said loading tray and said sorting disk are driven equidirectionally and said control track extends essentially parallel to a connecting line extending between drive axles of said loading tray and said sorting disk.

3. The system for handling coins according to claim 1, wherein said loading tray and said sorting disk are driven counterdirectionally and said control track intersects a connecting line extending between drive axles of said loading tray and said sorting disk.

4. The system for handling coins according to claim 3, wherein between said loading tray and said sorting track and sorting disk there is provided a return track by way of which coins can be returned from an end of said sorting track to said loading tray.

5. The system for handling coins according to claim 2, wherein between said loading tray and said sorting track and sorting disk there is provided a return track by way of which coins can be returned from an end of said sorting track to said loading tray.

6. The system for handling coins according to claim 1, wherein between said loading tray and said sorting track and sorting disk there is provided a return track by way of which coins can be returned from an end of said sorting track to said loading tray.

7. The system for handling coins according to claim 1, wherein said control track comprises several parts driven independently of one another.

8. The system for handling coins according to claim 1, wherein said coin sensing device comprises a coin recognition device and said control track is further provided with a coin stop device and a coin deflection device.

9. The system for handling coins according to claim 8, wherein between said loading tray and said sorting track and sorting disk there is provided a return track by way of which coins can be returned from an end of said sorting track to said loading tray.

10. The system for handling coins according to claim 8, wherein said loading tray and said sorting disk are driven equidirectionally and said control track extends essentially parallel to the connecting line extending between drive axles of said loading tray and said sorting disk.

11. The system for handling coins according to claim 10, wherein between said loading tray and said sorting track and sorting disk there is provided a return track by way of which coins can be returned from an end of said sorting track to said loading tray.

12. The system for handling coins according to claim 8, wherein said loading tray and said sorting disk are driven counterdirectionally and said control track intersects a connecting line extending between drive axles of said loading tray and said sorting disk.

13. The system for handling coins according to claim 8, wherein said control track comprises several parts driven independently of one another.

* * * * *